US006864825B2

(12) United States Patent
Holly

(10) Patent No.: US 6,864,825 B2
(45) Date of Patent: Mar. 8, 2005

(54) METHOD AND APPARATUS FOR DIRECTING ELECTROMAGNETIC RADIATION TO DISTANT LOCATIONS

(75) Inventor: Sandor Holly, Woodland Hills, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/444,510

(22) Filed: May 23, 2003

(65) Prior Publication Data

US 2004/0120093 A1 Jun. 24, 2004

Related U.S. Application Data

(60) Provisional application No. 60/385,290, filed on May 31, 2002.

(51) Int. Cl.[7] ..... G01S 7/38

(52) U.S. Cl. ..... 342/13; 342/54; 342/59; 342/126; 342/175; 342/14

(58) Field of Search ..... 342/13, 14, 52, 342/54, 59, 118, 126, 175; 455/1

(56) References Cited

U.S. PATENT DOCUMENTS

| | | | | |
|---|---|---|---|---|
| 3,348,093 A | | 10/1967 | Holly | |
| 4,604,638 A | * | 8/1986 | Matsuda | 257/132 |
| 5,420,595 A | | 5/1995 | Zhang et al. | |
| 5,432,605 A | * | 7/1995 | Naqwi et al. | 356/485 |
| 5,856,803 A | | 1/1999 | Pevler | |
| 6,512,385 B1 | * | 1/2003 | Pfaff et al. | 324/753 |

OTHER PUBLICATIONS

"Geometrical wake of a smooth flat collimator", Stupakov, G.V.;Particle Accelerator Conference, 1997. Proceedings of the 1997 May 12–16, 1997 pp.: 1685–1687 vol. 2.*

Peter H. Siegel, *Terahertz Technology, IEEE Transactions on Microwave Theory and Techniques*, Mar. 2002, pp. 910–928, vol. 50.

Peter H. Siegel, *THz Technology: An Overview, International Journal of High Speed Electronics and Systems*, 2003, pp. 1–44, vol. 13—No. 2, World Scientific Publishing Company, USA.

Sanjay Raman, N. Scott Barker, and Gabriel M. Rebeiz; *A W–Band Dielectric–Lens–Based Integrated Monopulse Radar Receiver*, IEEE Transactions on Microwave Theory and Techniques; Dec. 1998; pp. 2308–2316; vol. 46, No. 12.

Daniel F. Filipovic, Gildas P. Gauthier, Sanjay Raman, and Gabriel M. Rebeiz; *Off–Axis Properties of Silicon and Quartz Dielectric Lens Antennas*; IEEE Transactions on Antennas and Propagation; May 1997; pp. 760–766; vol. 45, No. 5.

* cited by examiner

*Primary Examiner*—John B. Sotomayor
(74) *Attorney, Agent, or Firm*—Alston & Bird LLP

(57) ABSTRACT

A method of creating electromagnetic interference includes creating an electromagnetic (EM) field of a frequency at distant target by transmitting at least two electromagnetic beams. At the target, the beams may converge and interfere creating an interference difference frequency. In another method, the beams may be combined and the combined beams create an interference over a distance. An interference difference frequency is selected so that a desired electromagnetic frequency is established at the target creating interference. The interference difference frequency is established by the difference in the two electromagnetic beams. As each converges or is combined, the resultant frequency corresponds to the difference between each the frequencies of each beam. An apparatus for creating electromagnetic radiation includes at least two transmitters. The transmitters permit directing the electromagnetic beams in directions permitting either convergence of the beams or combination of the beams, thus creating electromagnetic interference.

14 Claims, 4 Drawing Sheets

METHOD AND APPARATUS FOR DIRECTING ELECTROMAGNETIC RADIATION TO DISTANT LOCATIONS

CROSS-REFERENCE TO RELATED APPLICATIONS

This application claims the benefit of U.S. Provisional Application No. 60/385,290, filed May 31, 2002, which is hereby incorporated by reference.

FIELD OF THE INVENTION

The present invention relates to methods and apparatuses for creating electromagnetic interference at distant locations, and, more particularly, to a method and apparatus for creating electromagnetic interference at arbitrary radio frequencies, microwave frequencies, and millimeter wave frequencies using controlled and directed electromagnetic energy.

BACKGROUND OF THE INVENTION

Modern electronic circuits are, in general, very sensitive to small amounts of external electromagnetic radiation, especially, when the radiation's frequency is at or near any one of the circuit's (or circuit components') resonances. Modern circuits contain multiple layers of circuit boards and integrated circuits that include millions of transistors, diodes, and other circuit elements. These circuit elements produce miniature dipoles, monopoles, and loop antennas, which are unintentionally created when the circuits were laid down.

The combination of these parts result in a very large number of resonances, which, when coupled with nonlinearities of many of the circuit elements, behave like many parallel receivers tuned to seemingly random distributed frequencies throughout the electromagnetic (EM) spectrum. Because modern circuits are highly complex, it is difficult to determine these resonances analytically, however the main resonant frequencies of devices can be relatively easily determined experimentally and their strengths measured quantitatively. As components become smaller, these circuit resonances shift to higher and higher frequencies, into the microwave region of the spectrum.

There are conditions under which it is desired to remotely interfere with electronic circuits, sensors, detectors or other electronic systems in a controlled way. In various military applications it is desirable to send an RF frequency in a narrow beam selectively focused at an electronic target to stop (or modify) its operation. In a civilian application it is highly desirable to be able to efficiently protect civilian aircraft against electromagnetically controlled weapons. For example, it is desirable to thwart a rogue surface to air missile by remotely denying its seeker to function properly. Therefore, there are many applications in both the military and in the civilian markets that need a directed energy (DE) method and apparatus to produce EM fields at a distant location. These EM fields should be of any frequency, from DC to millimeter wave frequencies throughout the electromagnetic spectrum.

Creating radio frequency (RF) interference, however, has been limited by the inability to beam lower frequency radiation, compared to the ease of collimating microwave and millimeter wave radiation. Also, it is difficult to generate the necessary power at lower frequencies to induce EM fields at a distance, i.e. the far field. In some cases, the amount of power may be realizable, but only for very short time periods, such as a few microseconds, and then the high power levels are dangerous to the immediately surrounding environment of the source.

As used herein, several terms should first be defined. Microwaves are the radiation that lies in the centimeter wavelength range of the EM spectrum (in other words: $1<\lambda<100$ cm, that is, the frequency of radiation in the range between 300 MHz and 30 GHz, also known as microwave frequencies). Electromagnetic radiation having a wavelength longer then 1 meter (or frequencies lower then 300 MHz) will be called "Radio Waves" or just "Radio Frequency" (RF). For simplicity in this disclosure, the RF spectrum is considered to cover all frequencies between DC (0 Hz) and 300 MHz. Millimeter Waves (MMW) are the radiation that lie in the range of frequencies from 30 GHz to 300 GHz, where the radiation's wavelength is less than 10 millimeters. Finally, electromagnetic frequencies from 300 GHz to 3 THz are described as submillimeter waves, but on some occasions are often lumped with millimeter waves. As known to those of ordinary skill in the art, for practical purposes the "borders" for these above 3 frequency ranges are often not precisely observed. For example, a cell phone antenna and its circuitry, operating in the 2.5+ GHz range is associated with RF terminology and considered as part of RF engineering. A wave guide component for example, covering the Ka band at a frequency around 35 GHz is usually called a microwave (and not a MMW) component, etc. Accordingly, these terms are used for purposes of consistently describing the invention, but it will be understood to one of ordinary skill in the art that alternative nomenclatures may be used in more or less consistent manners.

SUMMARY OF THE INVENTION

The present invention provides methods and apparatuses for creating electromagnetic interference at distant locations, thus offering a solution to the above needs. To this end, the methods and apparatuses provide an efficient way to transmit electromagnetic interference in the radio frequency region of the electromagnetic spectrum by using an interference difference frequency between two higher frequency electromagnetic beams. Therefore, the transmitted beams are easily to be collimated microwave, millimeter, or submillimeter wave radiation, yet produce lower frequency interference with sufficient field strength.

According to one embodiment of a method of creating electromagnetic interference, an electromagnetic (EM) field of a frequency, polarization, and amplitude is created on a distant target by transmitting at least two electromagnetic beams. At the target, the beams converge and interfere creating an interference difference frequency, which may be in the rage of radio frequency or higher, up to submillimeter waves. The frequency difference is selected so that a desired electromagnetic frequency is established at the target. For example, the interference difference frequency may be equal to a resonant frequency of an electronic device at the target, thereby interfering with the operation of the electronic device.

Another embodiment of a method for creating electromagnetic interference includes transmitting a single beam toward a distant target. In this embodiment, two electromagnetic beams are combined by a polarization beam combiner, beam splitter, or the like. The interference difference frequency is established by the combination, and the resultant beam may then be collimated and directed toward the distant target.

An embodiment of an apparatus for creating electromagnetic interference includes at least two transmitters for transmitting the electromagnetic beams. The transmitters radiate electromagnetic beams of different frequencies separated by a difference frequency. The difference frequency, therefore, defines the interference difference frequency when the two beams are converged at a distance. Another aspect of the transmitters may include a collimating antenna to precisely direct the beams in a direction that permits the convergence at a desired interference area.

The present invention provides the methods and apparatuses to deliver remotely, at a selected frequency, an electromagnetic field from a distance, possibly up to hundreds of kilometers. One purpose of such action could be to overcome adversaries in electronic warfare, to deny control, command and communications capabilities to our enemy or to remotely disarm (and destroy) a surface to air missile in pursuit of a civilian aircraft. Other possible applications of the invention include testing various circuits, sensors, detectors, etc. remotely; measuring, determining, and characterizing the sensitive frequencies of specific sensors, seeker systems, their sensitivity to polarization orientation, and the field intensities that are needed to confuse, to incapacitate, to damage and to destroy certain types of sensors and circuits. Many other advantages of the invention will become apparent to those skilled in the art with reference to the following descriptions.

BRIEF DESCRIPTION OF THE SEVERAL VIEWS OF THE DRAWINGS

Figure 1:
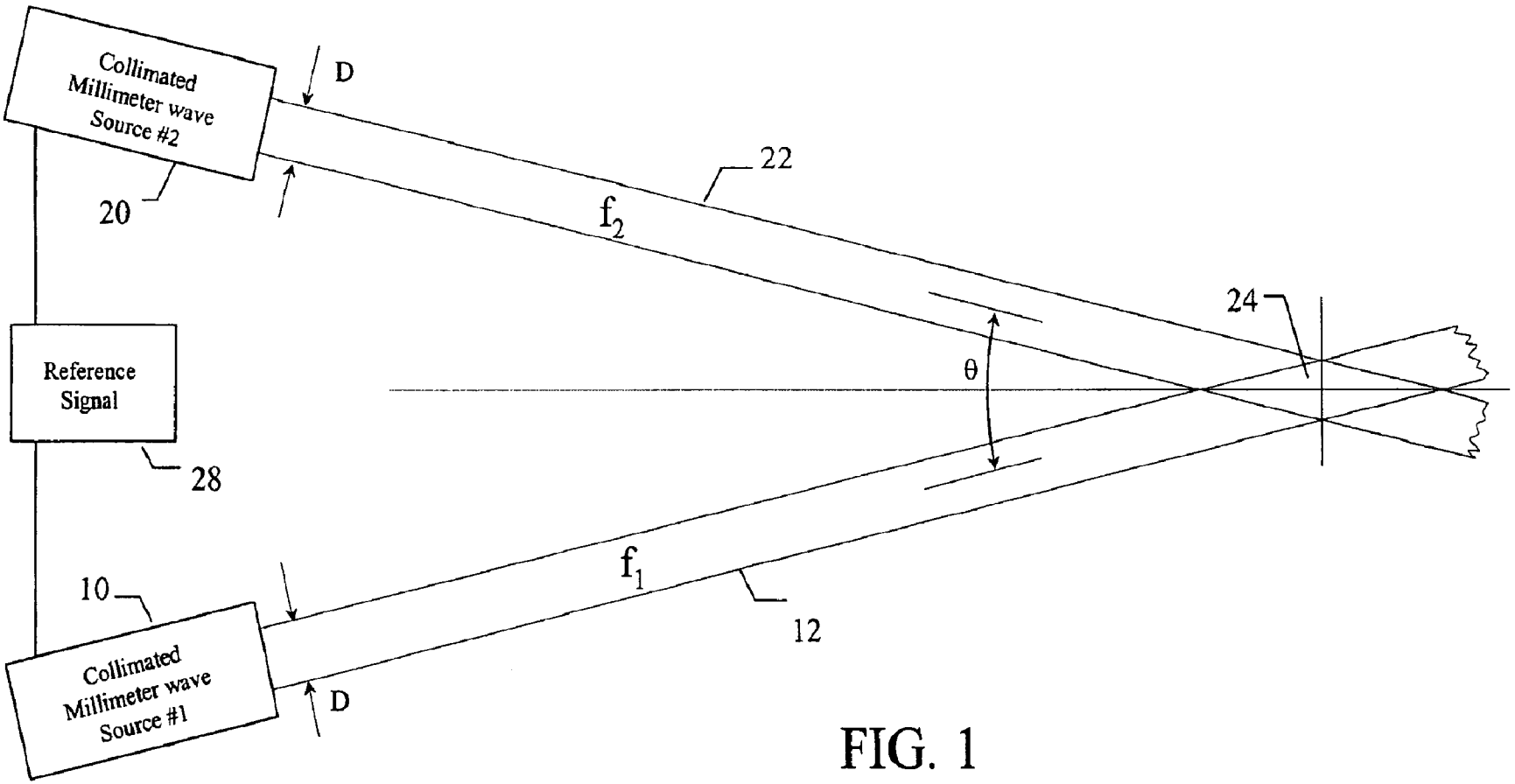
Figure 2:
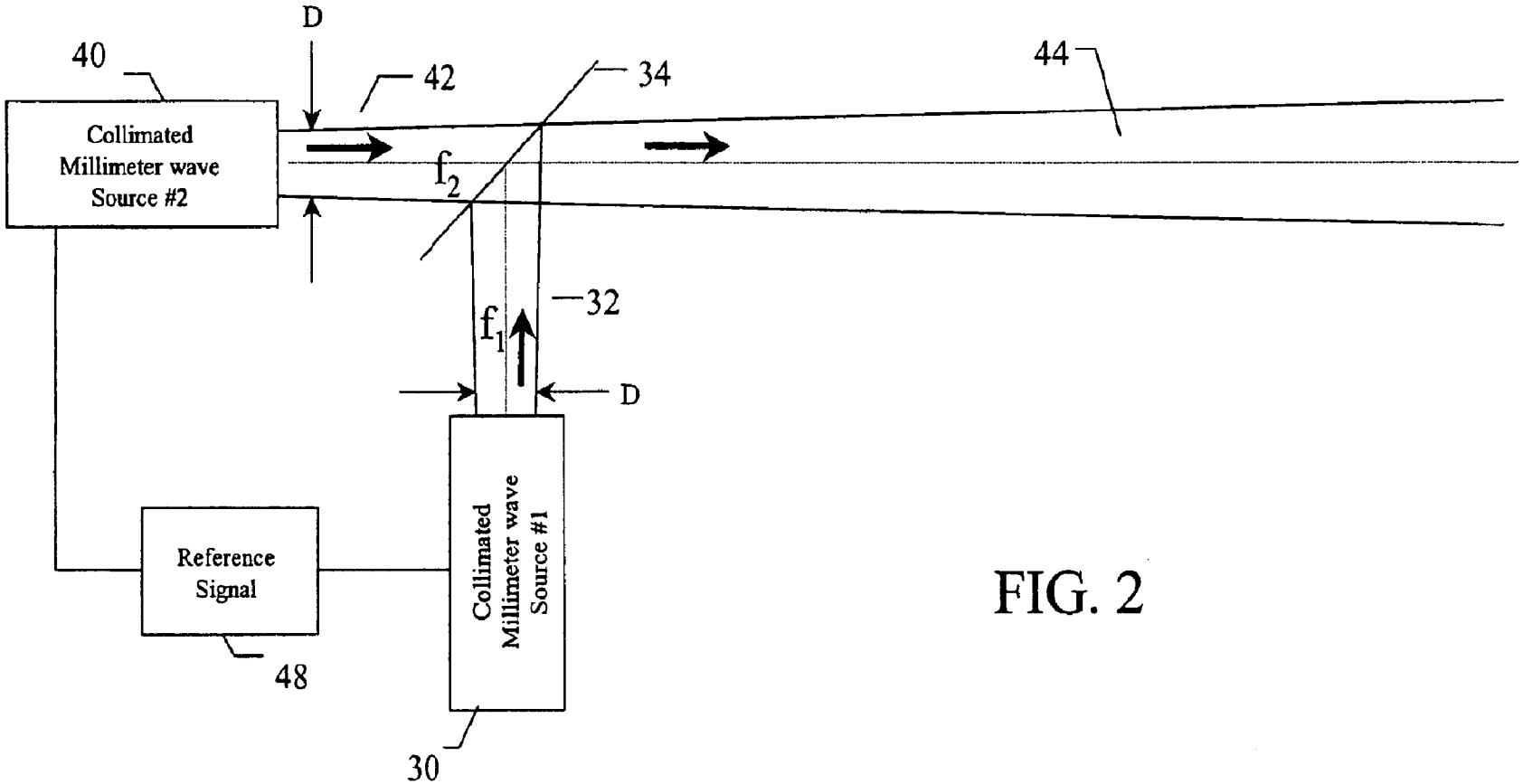
Figure 3:
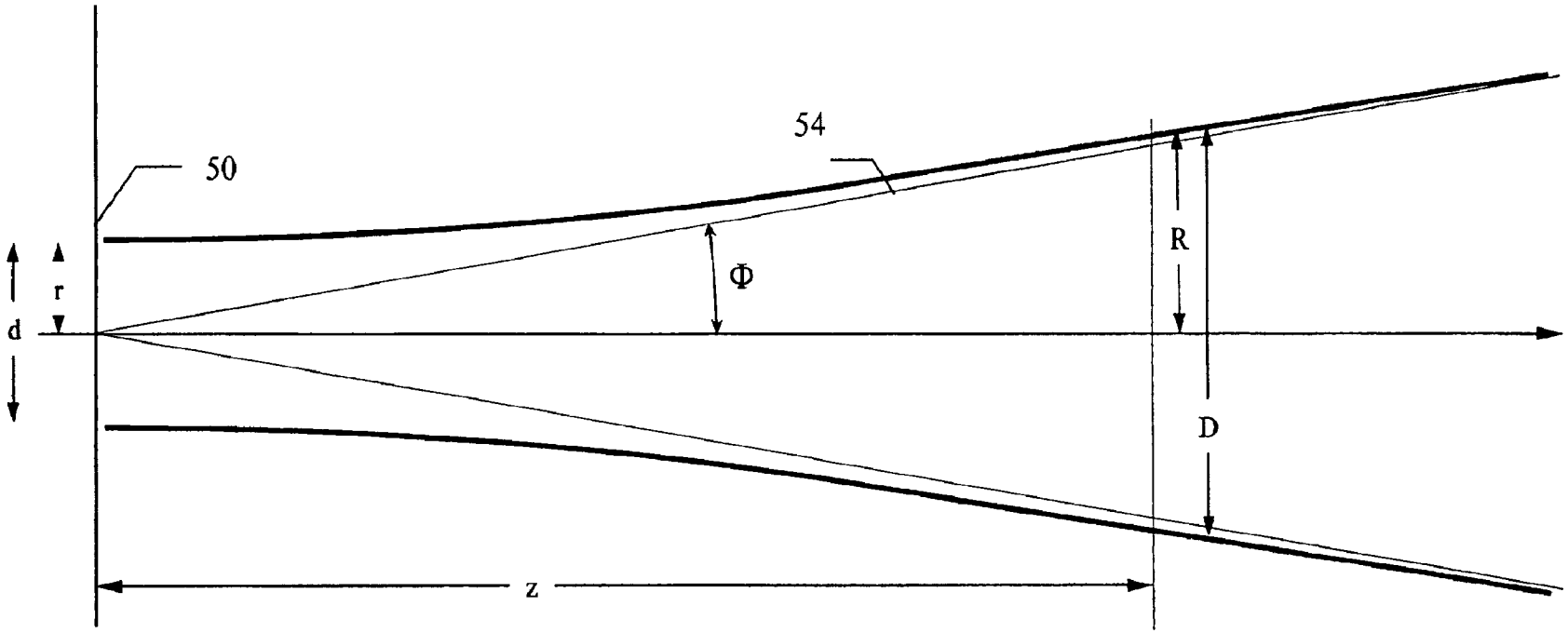
Figure 4:
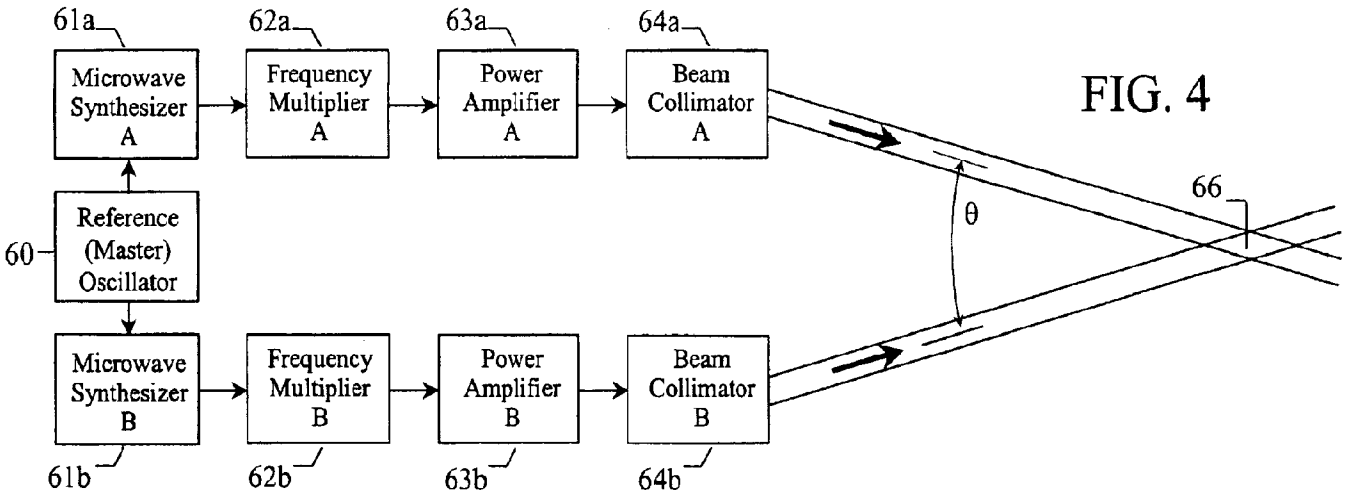
Figure 5:
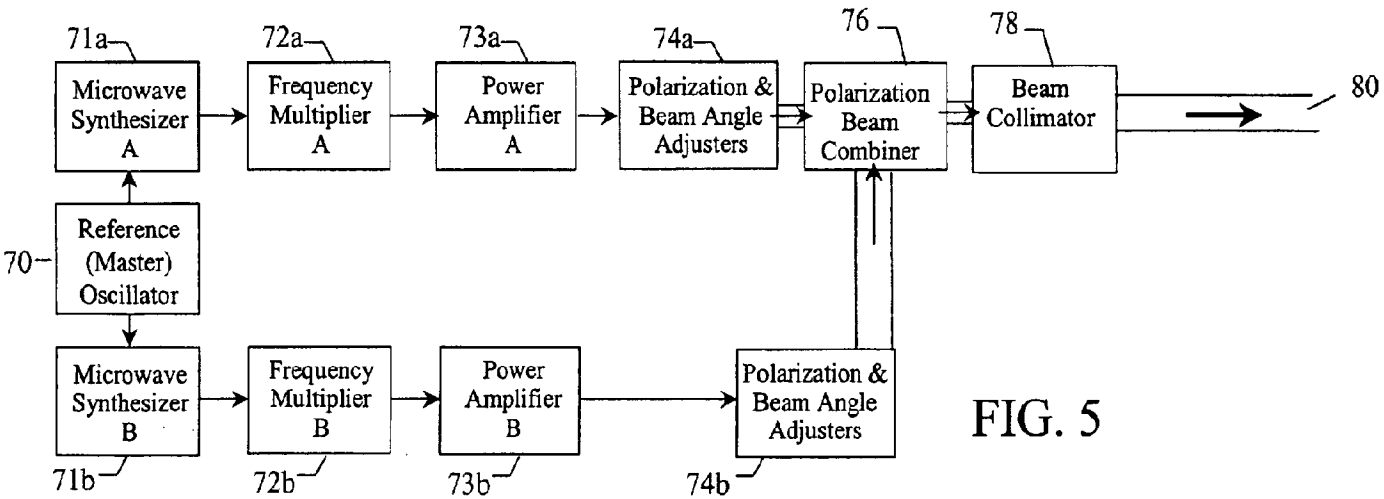

Having thus described the invention in general terms, reference will now be made to the accompanying drawings, which are not necessarily drawn to scale, and wherein:

FIG. 1 is a schematic representing the effects of combining two coherent collimated electromagnetic waves according to one embodiment of the present invention;

FIG. 2 is a schematic representing the effects of combining two coherent collimated electromagnetic waves with a polarization beam combiner according to one embodiment of the present invention;

FIG. 3 is a schematic representing the divergence of a collimated beam of electromagnetic waves according to one embodiment of the present invention;

FIG. 4 is a schematic representing an apparatus for creating electromagnetic interference according to one embodiment of the present invention; and FIG. 5 is a schematic representing an apparatus for creating electromagnetic interference according to one alternative embodiment of the present invention.

DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Referring to FIG. 1, two collimated millimeter wave sources 10, 20 are shown radiating collimated beams 12, 22 of electromagnetic radiation at two separate frequencies, $f_1$ and $f_2$, and in two intersecting directions that produce interference at a distance. Generally, when two electromagnetic beams of different frequencies converge, the volume of the intersection 24 will include a frequency component directly related to the difference in frequency of the two beams, which is defined herein as the interference difference frequency, $\Delta f$. More specifically, the electromagnetic interference at the interference difference frequency, $\Delta f$ is optimal in that the electromagnetic interference field strength is at a maximum when the beams are diffraction limited and collimated having substantially equal intensities and either linearly or circularly polarized. When the interference difference frequency is incident upon a target having electronic components at or near the interference frequency, the resultant field will interfere with the operation of the electronics.

The interference difference frequency, $\Delta f$ is generated by nonlinear surface and volume effects (such as oxide layers, corroded surfaces, etc.), also by nonlinear electronic circuit parts and components, such as diodes, transistors, which are parts of all integrated circuits, receiver front-ends, and other circuit parts that may resonate with either or both the main and difference frequencies that are projected. For example, when the collimated and coherent outputs of two distinct millimeter wave antennas are 100 GHz and 101 GHz, the electromagnetic field at the intersection 24 will include a 1 GHz component. Physically, the interference pattern created in the volume of the intersection of collimated parallel polarized beams is a fringe field where the fringe planes are approximately parallel to one another. The fringe planes are traveling in a direction perpendicular to the planes at the rate of the interference difference frequency, i.e. difference between the frequencies. The fringe planes are separated by the fringe period, $\lambda_f$, which is determined by $$\lambda_f = \frac{\lambda_o}{2\sin\frac{\theta}{2}}$$

where $\lambda_0$ is the wavelength of the collimated beams, and $\theta$ is the angle of intersection between the two collimated beams. As can be seen, the fringe period depends upon the angle of intersection of the intersecting beams. Additionally, when the beams are at substantially equivalent field strengths, full amplitude modulation of the interference field will be achieved.

According to the method of creating an electromagnetic interference, the interference will be directed at a distance toward a direction of a target. A target has electronic or electrical components lying in the intersection volume, and will be exposed to the remotely created electromagnetic field. Due to non-linear electronic characteristics of the target, the target will produce and reradiate the difference frequency as surface and volume emissions. The interference difference frequency, $\Delta f$, of the electromagnetic field will induce currents at the interference difference frequency, $\Delta f$, in any conductors and semiconductors within or near that volume. The induced currents then interfere with electrical or electronics components especially when operating at or near one of its resonant frequencies, thereby hindering the operation of electronic components of the target.

FIG. 2 illustrates an alternate embodiment of an apparatus for creating electromagnetic interference at a distance in a special case of the converging angle $\theta=0$. Two collimating millimeter wave sources 30, 40 radiate collimated beams 32, 42 of electromagnetic radiation at two separate frequencies, $f_1$ and $f_2$, and in the direction of a polarization beam combiner. The polarization beam combiner combines orthogonally polarized beams by reflecting one beam and permitting transmission therethrough of the other beam. The resultant output is therefore the combined beams of both collimated beams 32, 42 having an interference difference frequency as described above. Again, for example, if $f_1$=100 GHz and $f_2$=101 GHz, the resultant interference difference frequency Δf=1 GHz. In contrast to the above description, however, the intersection angle, θ, between the two beams is reduced to zero. As such, the fringe period has become infinite, that is to say that there are now no fringes and no spatial variation of intensity in any plane perpendicular to the direction of beam propagation.

In a typical arrangement, the polarization beam combiner may be oriented at 45 degrees with respect to the beams (32, 42 in FIG. 2). The polarization beam combiner to be rotated to transmit the linearly polarized incident beam 42 with the minimum of loss. The other beam (32 in FIG. 2) will be polarized orthogonal to the first beam to obtain maximum reflection and minimum transmission loss through the polarizer. Once these two beams are combined, they are superimposed and may be directed toward a target. That is to say that both beams 32, 42 are transmitted within one effective beam rather than separate converging beams (as described in FIG. 1), and the resultant interference zone 44 is the volume occupied by the merged beams, from the polarizer to a particular target and beyond.

While FIG. 2 illustrates the two beams 32, 42 incident on the polarizer 34 at 45 degrees, it is known to those of skill in the art that other incident angles of the beams can be chosen. Also, while a linear polarization beam combiner has been discussed above other embodiments of beam combiners, known to those of ordinary skill in the art, including beam splitters, circular polarization beam combiners, and the like, and may be substituted accordingly.

According to one embodiment of a method of creating an electromagnetic interference, the interference will be directed at a distant target by combining the beams as in the above example. In this case, a target will have electronic or electrical components lying at any distance from the sources in the interference area 44 of the combined electromagnetic beams. Again, due to the non-linear electronic characteristics of a target, portions of the target will produce and reradiate the interference difference frequency. The interference difference frequency, Δf, of the electromagnetic field will therefore induce currents at the interference difference frequency, Δf, in any conductors and semiconductors within or near that volume. The induced currents therefore interfere with the electrical or electronic components especially those with resonant frequencies close to the induced interference difference frequency Δf.

As in the above examples, two electromagnetic beams of frequencies near 100 GHz intersect and cause an interference difference frequency. Consequently, the interference difference frequency can be tuned by making adjustments to the frequencies of the beams to effectively test a target that has electronics that have resonant frequencies near the interference difference frequency. The examples provided at nominal beam frequencies of 100 GHz and an interference difference frequency of 1 GHz are also practical realizations of millimeter wave and microwave transmission. In the current state of the art, collimating antennas in the short, millimeter wave, and submillimeter wavelength ranges can be made with reasonable dimensions and assure tightly collimated beams. On the other hand, lower frequencies (longer wavelength radiation) would require larger collimating antennas or have greater divergences. Other factors, described below, will also dictate the necessary antenna size, and radiating power requirements.

FIG. 3 illustrates the divergence of a collimated electromagnetic beam. An electromagnetic beam cannot be kept in perfect collimation over long distances. According to the laws of physics, the minimum divergence angle of a diffraction limited beam is related to the wavelength and the initial beam radius. Accordingly, the smallest beam spot-size that can be produced with a diffraction limited beam is given by $$D(z) = 2r\sqrt{1 + \left(\frac{\lambda z}{\pi r^2}\right)^2}$$

where D is the beam diameter at a particular distance z, r is the initial radius of the transmitted beam, and λ is the wavelength of the transmitted radiation, see FIG. 3. Correspondingly, for a given power in a collimated beam, as the beam diameter increases with distance, so the power density of the beam decreases by the square of the distance. Therefore, considerations of target distance, required beam diameter, and power densities for exposing a target at the intersection area of electromagnetic interference must be considered. Also, those of ordinary skill will recognize that methods and apparatus described herein are effective in the far field, given by the Rayleigh distance, $Z_R$.

$$Z_R = \pi r^2/\lambda$$

The foregoing descriptions describe methods and apparatuses for creating electromagnetic interference, and general considerations for implementation. Accordingly, one specific embodiment of an apparatus for creating electromagnetic interference is therefore depicted in FIG. 4. First and second frequency generators, which in this embodiment are microwave synthesizers 61*a*, 61*b* generate frequencies dependent upon the same reference frequency from a reference oscillator 60.

In each of the two signal paths from the frequency generator, a sinusoidal signal is provided to frequency multipliers 62*a*, 62*b* to increase the frequency of the sinusoidal signal into the millimeter wave region of the spectrum. In this case, microwave synthesizer frequency is multiplied to a new frequency in the range of 100 GHz, although the frequency generated by multiplication may be much higher. Also in each, power amplifiers 63*a*, 63*b* receive the MMW signal and increase the power intensity for transmission from separate antennas, in this case the antennas are beam collimators 64*a*, 64*b*. Accordingly, the each beam collimators 64*a*, 64*b* may direct each beam toward the target, thus creating the interference area 66 at the target. A beam collimator typically includes a transmitter, such as a horn transmitter, and may include a dielectric collimating lenses or a dish type parabolic antenna commonly used in collimating millimeter wave transmission. These and other types of antennas are known to those of ordinary skill in the art and may be substituted accordingly.

One example of a microwave synthesizer 61*a*, 61*b* includes the Agilent model no. 83623B manufactured by Agilent Technologies, Inc., of Palo Alto, Calif. This synthesizer model also includes its own reference oscillator, but may also be used with external reference oscillators. The frequencies of the two synthesizers will be chosen to create the desired interference difference frequency. In conjunction with the Agilent synthesizer, an example of the frequency multiplier includes a Frequency Multiplier model AMC-10-R000 produced by Millitech, Inc. of Northampton, Mass., which has an active multiplier chain of 6×. Millitech also produces a suitable W-band Power amplifier model AMP-10-R0000, that permits a frequency band of 75–100 GHz. A frequency in this range is suitably collimated by a Beam Collimator model GOA-10-R00006S from Millitech. These examples of hardware are provided for example only to provide sufficient reference to practice the invention, while other substitutes are known to those of skill in the art.

The Agilent synthesizer and others like it are commonly used and known to those skilled in the art. Additionally, they provide an ability to finely tune the output frequencies of the collimated beams. Also, because this type of synthesizer permits locking their reference frequencies together, the interference difference frequency, Δf, may be adjusted by independently tuning either one of the synthesizers with predictable effects on the interference difference frequency. This interference difference frequency may be tuned to any other frequency by tuning the synthesizer to a different frequency, either lower or higher thereby affecting the offset between the frequencies.

In an alternative embodiment shown in FIG. 5, electromagnetic interference may also be created at a distance with a single beam collimator 76 by first combining each electromagnetic beam at a polarization beam combiner 78. Again, the two electromagnetic beams are derived from frequency sources, in this case microwave synthesizers 71*a*, 71*b* locked to a reference frequency of the reference oscillator 70. Frequency multipliers 72*a*, 72*b* and power amplifiers 73*a*, 73*b* likewise provide the desired frequencies and intensities for transmitting the electromagnetic beams. Polarization and beam angle adjusters 74*a*, 74*b* therefore are used to direct both beams to the polarization beam combiner 76 to create a combined circularly polarized beam with an interference difference frequency. Then the combined beam is collimated in a direction toward the target. In this case, the interference field 80 is at any distance in the direction of the beam from the combiner 76. The hardware elements of this embodiment are similarly described in the previous embodiment and other substitutes are known to those of skill in the art. One example of a suitable polarization beam combiner includes a model GOA-100006D also produced by Millitech, however, other acceptable polarization beam combiners are known to those of ordinary skill and may be substituted without departing from the spirit or scope of the invention.

While the frequency generators described herein are microwave synthesizers, other frequency generators may be appropriately substituted, such as microwave oscillators, radio frequency oscillators, etc. In the current state of the art, frequency multipliers permit an easily developed embodiment of a frequency generator, as it facilitates frequency generation that is too high to synthesize directly. In the near future, it is expected in that synthesizers will more easily permit direct synthesis of higher frequencies and thus obviate the need to use frequency multipliers. Similarly, higher power frequency generators are being developed and may be substituted accordingly without departing from the spirit or scope of the present invention. As such, it is expected that off the shelf components may provide sufficient frequency ranges and power requirements in order to meet various future application needs.

In summary, a method and apparatus are provided that effectively create electromagnetic interference at these and other frequencies and project the interference a distance from the transmitters, as would be expected from a real world electromagnetic interference threat. Accordingly, the method and apparatus can be used to create electromagnetic interference at a target in order to effectively prepare for and test electromagnetic defensive measures.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of creating an electromagnetic interference field at a distance, comprising:

transmitting a first electromagnetic beam at a first frequency and in a first direction;

transmitting a second electromagnetic beam at a second frequency and in a second direction, wherein the second frequency is offset from the first frequency to define an interference difference frequency, and the first and second electromagnetic beams interfere at a far field distance corresponding to an intersection of the first and second electromagnetic beams;

collimating the first and second electromagmetic beams in the third direction; and combining the first and second beam in a third direction.

2. The method according to claim 1, wherein the step of collimating the first and second electromagnetic beams comprises collimating the first electromagnetic beam in a first direction and collimating the second electromagnetic beam in the second direction.

3. The method according to claim 1, further comprising combining the first and second electromagnetic beams.

4. The method according to claim 3, wherein the step of combining the first and second electromagnetic beams comprises combining linearly polarized first and second beams through a polarization beam combiner.

5. The method according to claim 3, wherein the step of combining the first and second electromagnetic beams comprises combining circularly polarized first and second beams through a circular polarization beam combiner.

6. An apparatus for creating an electromagnetic interference field at a distance, comprising:

a first transmitter configured to transmit a first electromagnetic beam at a first frequency and in a first direction; d a second transmitter configured to transmit a second electromagnetic beam at a second frequency and in a second direction, wherein the second frequency is offset from the first frequency to define an interference difference frequency, and the first and second transmitters are configured such that the first and second beams interfere at a far field distance corresponding to an intersection of the first and second directions;

a beam combiner for combining the first and second electromagnetic beams; and a collimator for collimating the combined first and second electromagnetic beams in a third direction.

7. The apparatus according to claim 6, further comprising a first collimator for collimating the first electromagnetic beam in the first direction, and a second collimator for collimating the second electromagnetic beam in the second direction.

8. The apparatus according to claim 6, wherein the first transmitter comprises:

a frequency generator configured to generate a signal at a predetermined frequency; and an antenna in communication with the frequency generator for radiating the first electromagnetic beam in the first direction.

9. The apparatus according to claim 8, wherein the antenna comprises a collimating antenna.

10. The apparatus according to claim 9, wherein the frequency generator comprises a microwave synthesizer.

11. The apparatus according to claim 9, wherein the first transmitter further comprises:

a frequency multiplier in communication with the frequency generator for multiplying the predetermined frequency to the first frequency; and a power amplifier in communication with the frequency multiplier for increasing the power output of the antenna.

12. An apparatus for creating electromagnetic interference, comprising a frequency reference for providing a reference signal;

first and second collimating transmitters, each transmitter comprising, a frequency generator, in communication with the frequency reference, and configured to generate a signal at a predetermined frequency based upon the frequency reference;

a collimating antenna, in communication with the frequency generator, for transmitting and collimating an electromagnetic beam in a direction and at the predetermined frequency, wherein the first transmitter provides a first a collimated beam at a first predetermined frequency and in a first direction, the second transmitter provides a second collimated beam at a second predetermined frequency and in a second direction, and the second frequency is offset from the first frequency to define an interference difference frequency, and the first and second transmitters are configured such that the first and second collimated beams interfere at a far field distance corresponding to an intersection of the first and second directions; and a non-linear electronic element disposed in the intersection for inducing currents at the interference difference frequency.

13. An apparatus for creating electromagnetic interference, comprising a frequency reference for providing a reference signal;

a first transmitter and a second transmitters, each transmitter for transmitting electromagnetic beams having frequencies separated by an interference difference frequency, each transmitter comprising:

a wave form synthesizer, in communication with the frequency reference, and configured to generate a signal at a predetermined frequency based upon the frequency reference; and an antenna, in communication with the synthesizer, for transmitting an electromagnetic beam in a direction;

a beam combiner for combining the electromagnetic beams; and a collimator for collimating the combined electromagnetic beams in a direction.

14. A method of creating an electromagnetic interference field at a distance, comprising:

transmitting a first electromagnetic beam at a first frequency and in a first direction;

transmitting a second electromagnetic beam at a second frequency and in a second direction, wherein the second frequency is offset from the first frequency to define an interference difference frequency, and the first and second electromagnetic beams interfere at a far field distance corresponding to an intersection of the first and second electromagnetic beams; and generating interference in a non-linear electronic element in the intersection.

* * * * *